US005288957A

United States Patent [19]

Swaybill

[11] Patent Number: 5,288,957

[45] Date of Patent: Feb. 22, 1994

[54] ILLUMINATED TOUCH BUTTON SWITCH

[75] Inventor: Bruce P. Swaybill, Farmington, Conn.

[73] Assignee: Otis Elevator Company, Farmington, Conn.

[21] Appl. No.: 997,059

[22] Filed: Dec. 28, 1992

[51] Int. Cl.[5] ..... H01H 9/16

[52] U.S. Cl. ..... 200/317

[58] Field of Search ..... 200/317, 310; 362/26, 362/27

[56] References Cited

U.S. PATENT DOCUMENTS 4,360,722 11/1982 Georgopulos ..... 200/317 X 4,778,966 10/1988 Obata et al. ..... 200/310 X 4,991,535 2/1991 Kobayashi et al. ..... 116/DIG. 20

5,039,832 8/1991 Polacek et al. ..... 200/317

5,093,764 3/1992 Hasegawa et al. ..... 362/26 X

*Primary Examiner*—Renee S. Luebke

[57] ABSTRACT

A touch button switch includes a light conducting body (10) having a conductive actuator (28) slidable from one end against a surface (62) to actuate a switch (61) on a board (52) which is held in place by hook laches (53) engaging mortises (55) in the circuit board. The circuit board has LEDs (58) which illuminate the rear edge of the body, which causes the light to be visible at its front surfaces 20, 21.

5 Claims, 1 Drawing Sheet fig. 1
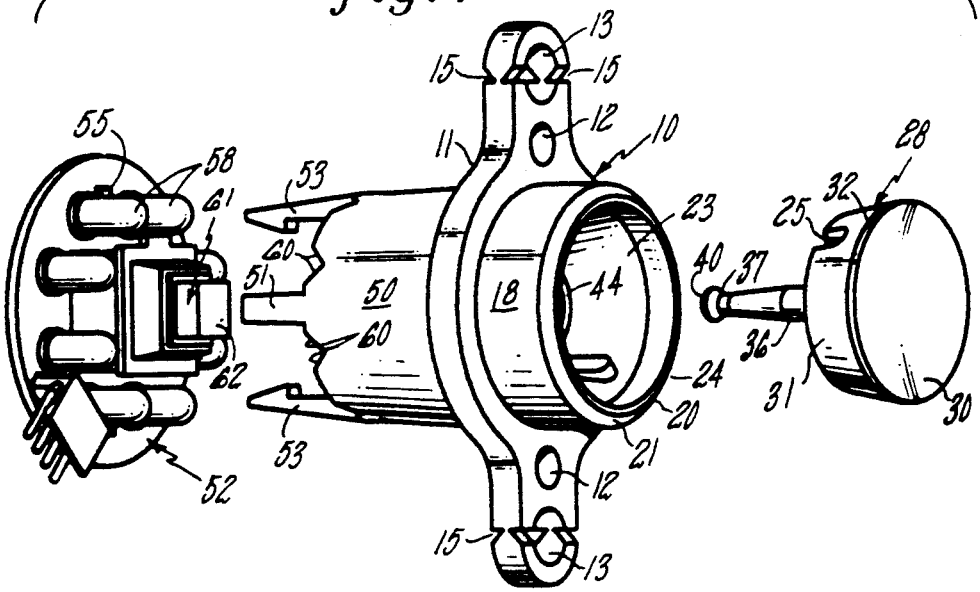
fig. 2
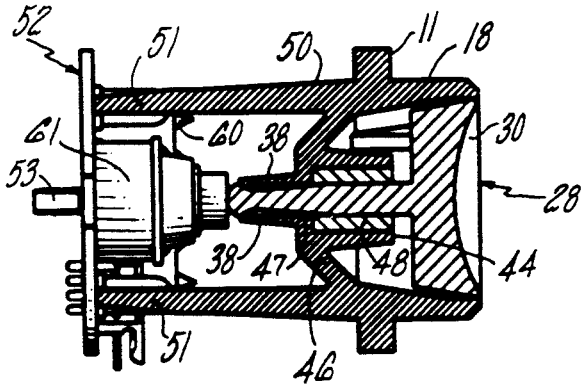
fig. 4
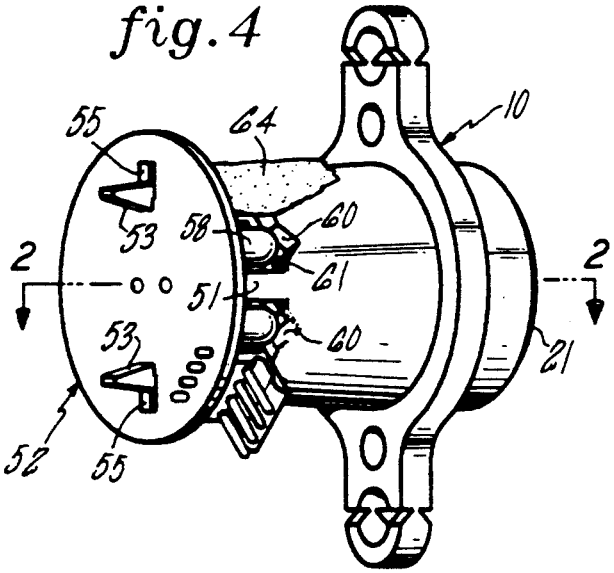
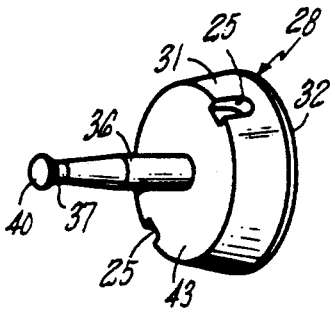
fig. 3

ILLUMINATED TOUCH BUTTON SWITCH

CROSS REFERENCE TO RELATED APPLICATION

Some of the subject matter herein is disclosed and claimed in a commonly owned, co-pending U.S. patent application of Swaybill et al entitled "Convertible Hybrid Touch Button Switch", filed contemporaneously herewith, U.S. Ser. No. 977,052.

1. Technical Field

This invention relates to touch button switches of the type commonly used for passenger call buttons in elevator systems.

2. Background Art

It is known in elevator systems to use touch button switches for hall call switches by means of which passengers call elevators for service at a floor of a building, as well as for car call buttons by means of which passengers within the elevator select a floor at which they wish the car to stop. The call buttons may either comprise tactile switches, which cause transfer of a switch armature from a normally open to a normally closed position, with or without a noticeable spring response, or they may be motionless, such as are operated by interaction with capacitance effects of a human body member. Early call buttons included a lamp to illuminate the entire touch pad following actuation of the switch, in order to provide an indication of response to the passenger. More recently, rings of light-emitting diodes (LEDs) have been used to illuminate a ring surrounding the touch pad in order to provide the response indication.

Typically, the general framework of touch button assemblies are formed around a hollow cylinder of light conducting material, such as clear plastic, the proximal end (the end near the touch pad where the response indicating light is visible), is enlarged to provide a lip which prevents the body from slipping through a car operating panel or hall call escutcheon plate, after being inserted into the panel or plate from the front thereof (the term "panel" hereinafter will be deemed to include escutcheons and other structures to which a touch button may be mounted). Typically, the body will be secured to the panel by means of a threaded lock nut or knurl on the back side thereof, or by means of screws through a flanged frame or other structure that is otherwise secured to the body of the touch button. The requirement that the touch button be passed from the front through to the rear, and secured from the rear makes the assembly of panels difficult and expensive. Furthermore, this renders servicing of the touch buttons more troublesome. One of the difficulties is the fact that the touch button is actually assembled only when it is in place, because all of the parts cannot be put together until a portion of it has been inserted through the panel. Buttons of this sort are also quite expensive since the frames that bring all the parts together are difficult to mold, and there are many parts that have to be fastened together in order to complete an assembly. While many improvements have been made in touch buttons of the type used in elevators, many of the aforementioned difficulties remain. A touch button of this type is disclosed in U.S. Pat. No. 5,039,832.

DISCLOSURE OF INVENTION

Objects of the invention include provision of a touch button which can be inserted into and mounted within a panel from the rear thereof, a touch button which has relatively few parts to bring together at final assembly to a panel, a touch button which is extremely simple to maintain, and one which is very low in cost.

According to the invention, a touch button switch comprises a hollow cylindrical light conducting body having a mounting flange disposed a short distance from a light emitting, proximal end thereof, with a plurality of hook latches and stops formed amidst light receiving facets in the distal end thereof, said body made of light transmitting material, a touch button disposed within said body and captured for limited axial motion therewithin, and a circuit board having light emitting diodes disposed thereon in a closed array and adapted to illuminate the distal end of said body portion, said circuit board having mortises to engage each of said hook latches when coaxially aligned with said body portion abutting said stops. The mounting flange may have break away mounting holes to permit gang-mounting of adjacent touch buttons with common screws or studs.

A touch button of the present invention can be completely assembled before being inserted into a panel or escutcheon; it can be snapped together and easily disassembled, new circuit boards (and lights) can easily be snapped on, and it can be worked entirely from the rear of the panel. A touch button of the present invention is extremely low in cost, being a small fraction of the cost of similar touch buttons known to the prior art, and is less costly to maintain and repair.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1 is an exploded perspective view of a touch button in accordance with the present invention;

FIG. 2 is a sectioned top view of a touch button taken on the line 2—2 in FIG. 4;

FIG. 3 is a perspective view of an actuating member of the touch button switch of FIGS. 1 and 2; and FIG. 4 is a perspective view of a completely assembled touch button in accordance with the present invention.

BEST MODE FOR CARRYING OUT THE INVENTION

Referring to the drawing, the touch button of the invention includes a generally cylindrical, hollow main body portion 10 having a flange 11 with mounting holes 12, 13 therethrough to permit mounting the touch button to a panel with screws or studs. The flange is provided with notches 15 to facilitate twisting off the ends of the flange near the holes 13, thereby to permit stacking of touch buttons on common screws or studs, if desired.

A proximal portion 18 of the body 10 has an essentially cylindrical outer surface of a constant diameter, to permit inserting the proximal end 18 of the body 10 through a hole in a panel, with a close fit which will leave a pleasing appearance. The proximal end 18 has a circular flat edge 20 and a beveled edge 21, through both of which light will be emitted in a manner described hereinafter. The proximal end 18 has an interior frustoconical surface 23 that assists in steering a maximum amount of light to the surfaces 20, 21.

A pair of ribs 24, formed integrally in the surface 23 (only one of which is shown) interact with a pair of corresponding slots 25 in a metal actuator 28, in order to correctly align the actuator 28 with respect to the panel to which the touch button is fastened, so that legends (such as "alarm") or floor numbers which may be disposed thereon have the correct vertical alignment, or to permit brushed or other aesthetic surfaces to be correctly aligned with the corresponding panel. The actuator 28 has a touch pad surface 30 which is touched by the operator in order to induce a response. The actuator 28 may have a slightly beveled surface 31 to allow it to traverse inwardly without colliding with the frustoconical surface 23 of the body 10. The actuator 28 may have a slight edge bevel 32 for aesthetic purposes, if desired. A stem 36 includes a peripheral notch 37 that engages the minimum diameter ends of fingers 38, 39 (FIG. 2) within the body 28 which are formed by a slot in a hollow frustocone. This captures the actuator 28 while allowing it to slide outwardly until a knob 40 formed adjacent the slot 37 engages the ends of the fingers 38, 39. The actuator 28 can move inwardly until an inner surface 43 thereof (FIG. 3) engages a boss 44 (FIGS. 1 and 2) formed on a central core 46 of the member 10. The core 46 has an axial bore 47 within which the stem 36 may slide. The bore 47 may be sleeved with a bronze bushing 48, to avoid excessive wear to the body 10, if desired.

A distal portion 50 includes a pair of stops 51 with edge surfaces (not shown) against which a circuit board 52 will abut when the circuit board is secured in the position shown in FIG. 4 by means of a pair of hook latches 53 which engage the circuit board 52 through mortises 55. The hook latches 53 can be distorted outwardly slightly in order to permit passing them through the mortises 5 in the circuit board 52 as the circuit board is installed to the body 10. This is an important aspect of the present invention: all of the electronics for the touch button can be mounted to the body without any screw fasteners whatsoever; and, no additional frames or mounting structures are required.

A plurality of LEDs 58 are disposed in a circle on the circuit board 52 in a manner so that the centers thereof coincide essentially with the center of the wall of the distal end 50 of the body 10, each LED 58 being aligned with a pair of corresponding facets 60 formed by notches in the edge surface of the distal end 50 of the body 10. In the known manner, when the touch button has been operated and the electronics senses that fact, the electronics responds by notifying the elevator controller and illuminating the LEDs, the light from which is picked up by the facets 60 and carried along the generally cylindrical wall of the body 10 to the surface 20, 21, where the light is visible to the operator of the touch button.

A tactile switch assembly 61 is mounted on the circuit board 52 in a position so that it can be actuated by the stem 36 whenever the touch pad 30 is pressed sufficiently to slide the actuator 28 inwardly until it hits the boss 44. The switch may be a micro dot switch or other compact tactile switch, such as an ITT Shadow, Part No. DC 61-41. On the other hand, in place of the switch assembly 61, an electrical contact can be placed on a surface which is in a position equivalent to the surface 62 of the switch 61. Or, the switch assembly 61 can be utilized with an electrically conducting contact on the surface 62, said electrical contact being connected with circuitry on the circuit board 52 (or another piggyback circuit board) so as to be able to operate the circuitry in response to capacitive effects by a body member contacting the touch pad 30, in the well-known way of capacitive sensing solid state touch button switches, as set forth completely in U.S. Pat. No. 5,036,321, the entirety of which is incorporated herein by reference. If the switch assembly 61 is provided with an electrically conductive pad 62, the switch can be operated both in response to capacitive effects as set forth in the '321 patent, and by pushing a little harder, by means of mechanical motion of the switch contacts within the switch assembly 61. If on the other hand, no electrical contact is provided on the surface 62, and the equivalent circuitry for operating a motionless switch is not provided on the circuit board 52, then a touch button in accordance with the present invention is simply a tactile switch touch button. Or, if a conducting surface 62 is provided in the position shown in FIG. 1, but without a tactile switch assembly 61, then the touch button of the present invention can be operated simply as a solid state, motionless touch button switch as in the aforementioned '321 patent. Yet another option is to provide the switch assembly 61 with the electrical contact on the surface 62 and with the motionless circuitry of the '321 patent on the circuit board 52, and utilize the switch as either a tactile switch or as a motionless switch, simply by: disconnecting the conducting surface 62, or insulating it from the actuator 28 in order to have the touch button operate simply as a tactile switch; or, the same switch can be provided with a spacer which prevents the actuator 28 from being moved inwardly at all by taking up all the space between the surface 43 of the actuator 28 and the boss 44 (FIG. 2) in the core of the body 10. All of this is further disclosed and claimed in the aforementioned copending application.

To prevent light from one touch button from illuminating an adjacent touch button, a light shield 64, comprising an opaque plastic sleeve or tube, such as vinyl, surrounds the LEDs 58, at least partially along the distal portion 50, as shown only partially in FIG. 4; it may extend between the circuit board 52 and the flange 11.

Thus, the present touch button is not only significantly improved, capable of easy assembly, installable and serviceable from a single side of a panel, easy to maintain, and the like, but it also provides numerous options for use. It can be used as only a tactile switch touch button, or as only a motionless touch button, or as both a tactile switch and a motionless touch button, or as a touch button having both tactile switch and motionless capabilities, but capable of being operated in only one or the other fashion, in an easily effected way, all as set forth and claimed in the aforementioned copending application. Thus, the touch button in accordance with the present invention is extremely versatile.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A touch button, comprising:

a generally cylindrical body of light transmitting material having a light emitting edge at a proximal end thereof, having a plurality of hook latches extending longitudinally outward from a distal end thereof, having at least one stop surface near said distal end, having light receiving edge surfaces at said distal end, and having a bore axially disposed between said ends;

a circuit board having a plurality of light-emitting diodes disposed on a surface thereof and having a mortise for each of said hook latches, said light emitting diodes positioned to illuminate said light receiving surfaces with said circuit board urged against said stop surface and said hook latches extending through said mortises and engaging said circuit board; and an actuator having a touch pad at a proximal end and a stem at a distal end, said actuator disposed within said body with said stem within said bore and said touch pad near said light emitting edge.

2. A touch button according to claim 1 wherein said actuator is slidable within said bore and further comprising:

a switch assembly disposed on said circuit board to be operable by sliding said actuator to a distal position within said body.

3. A touch button according to claim I including a mounting flange extending radially outwardly of said body between its ends.

4. A touch button according to claim 1 wherein said body includes a finger extending longitudinally outward from said bore near the distal end of said bore and wherein said stem has a notch cooperating with the distal end of said finger so as to capture said actuator in said body.

5. A touch button according to claim 1 including a light shield comprising a tube of opaque plastic surrounding said light emitting diodes and said light receiving edges.

* * * * *